US005240334A

United States Patent [19]

Epstein et al.

[11] Patent Number: 5,240,334

[45] Date of Patent: Aug. 31, 1993

[54] HAND HELD MULTILINE PRINTER WITH BASE MEMBER FOR GUIDING

[76] Inventors: Saul Epstein, 14558 Deervale Pl.; Stephen Kurtin, 3835 Kingswood Rd., both of, Sherman Oaks, Calif. 91403

[21] Appl. No.: 894,721

[22] Filed: Jun. 4, 1992

[51] Int. Cl.[5] ..... B41J 3/36

[52] U.S. Cl. ..... 400/88; 33/1 M; 33/566; 346/143

[58] Field of Search ..... 400/18, 23, 24, 29, 400/30, 88, 120; 33/1 M, 19.2, 32.2, 41.6, 41.1, 566; 346/143

[56] References Cited

U.S. PATENT DOCUMENTS 4,591,969 5/1986 Bloom ..... 400/902

4,611,246 9/1986 Nihei ..... 346/143

4,978,979 12/1990 Asakawa ..... 400/23

*Primary Examiner*—David A. Wiecking

*Assistant Examiner*—Steven S. Kelley

*Attorney, Agent, or Firm*—Saul Epstein

[57] ABSTRACT

A hand held printer and guiding means which maintains the printer in a fixed angular orientation with respect to an article to be printed, such as an envelope, and which constrains the printer to move linearly in a series of parallel line segments whereby an address can be printed on the envelope. Also disclosed is a printer and printer control system which utilizes a two dimensional position encoder using a ball which rolls on the surface to be printed to control the printing of data stored in a RAM memory in the printer.

27 Claims, 7 Drawing Sheets

HAND HELD MULTILINE PRINTER WITH BASE MEMBER FOR GUIDING

BACKGROUND OF THE INVENTION

In most modern business offices, letters are created on a computer and printed on laser printers. Unfortunately, it is not usually convenient to address envelopes on laser printers because i) most laser printers are not well adapted for printing envelopes, ii) most laser printers are shared among several people, and iii) very few laser printers include means for feeding envelopes remotely. As a result most envelopes have continued to be addressed by typewriter. In addition to taking more time, and the necessity for keeping relatively large pieces of otherwise unneeded equipment in cramped offices, addressing by typewriter creates the possibility of errors, which is undesirable.

There has thus been a need for a product which will accept address data from a computer and produce an addressed envelope. To meet this need, machines have recently come on the market which produce labels from computer data using a thermal printing process. Many people object to using a label for their business correspondence, and in particular these labels, since they are made by a relatively low resolution thermal process, and hence not of letter quality.

It is an object of the present invention to produce high quality addresses directly on envelopes using computer generated address data.

SUMMARY OF THE INVENTION

The present invention provides a convenient and relatively inexpensive, yet high quality, means for addressing an envelope. There will no doubt be many applications for the invented printer, but the major intended application is as a computer peripheral device for the purpose of addressing envelopes. The invention will therefore generally be described in that context. However, it is anticipated that a substantial secondary application will be found in the printing of small graphic images, such as logos, etc. This application will also be discussed.

In the context of printing addresses on an envelope, it will usually be the case that one line of text will be printed on each pass of the printhead over the envelope. In the detailed description of the invention, therefore, this situation will be assumed without discussion, it being understood that if larger text is to be printed, the text will be printed as a graphic.

The expense and complication of envelope feeding and handling, as well as the need for a printhead motion mechanism, are avoided in the present invention by having these functions accomplished manually. The printing is done by a hand held manually swept printer of the general type disclosed in U.S. Pat. No. 3,767,020, issued to Rowe. The preferred printhead is of the "drop on demand" ink jet type., such as manufactured by the Hewlett-Packard Company of Palo Alto, Calif. for its DeskJet line of printers, but other types of printheads can also be used. The type of printhead best adapted to the invention prints a swath one text line high as it is swept across the receiving surface (e.g., an envelope). Also accomplished by manual means is the movement of the printhead from one line location to another.

Means to maintain a constant angular relationship between the printer and an article to be printed is provided, as is a positioning means for the printer to constrain its motion. For printing textual material, such as addresses, the positioning means constrains the printer motion to straight line segments of sufficient number and length to accommodate an addressee's name and address, and also, if desired, a postal bar code. The constant angular relationship between the hand held printer and the article to be printed is maintained even though the printer is moved in two directions while performing the printing function, i.e., covering an area of the article to be printed rather than a single line.

The electronic control circuitry associated with the printer provides printer status information to the user, and causes the text to be printed in the desired place without the necessity of close attention by the user.

The preferred ink jet type of printhead tends to collect bits of paper fiber and other debris from the surface over which the printer is swept. Also, the orifices through which the ink drops are emitted are so small that if the ink is allowed to dry, the orifices tend to plug. In order to avoid the consequences of these problems, a special storage unit or "cradle" has been devised which will clean the debris off the printhead in the region of the orifices after every use, and cap the printhead to prevent ink drying while the printhead is stored.

For a better and more complete description, and a discussion of other aspects of the invention, reference may be had to the following detailed description of the preferred embodiments of the invention, which should be read in conjunction with the appended drawings.

DETAILED DESCRIPTION OF THE INVENTION

Figure 1:
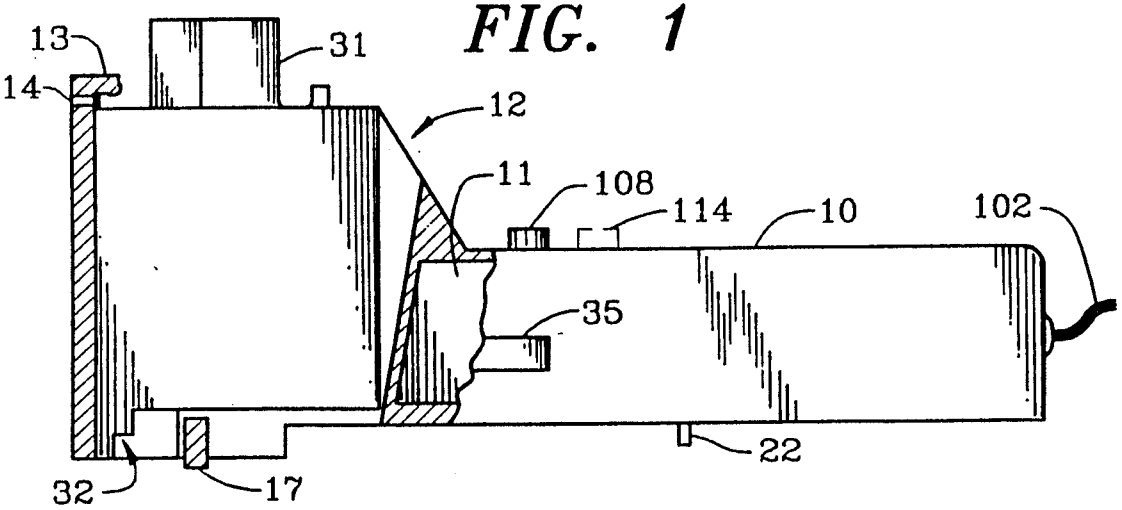
FIG. 1 is a partially sectioned side view of a printer for use in connection with a first embodiment of the present invention. The sectioned portion is taken at 1—1 of FIG. 3.
Figure 2:
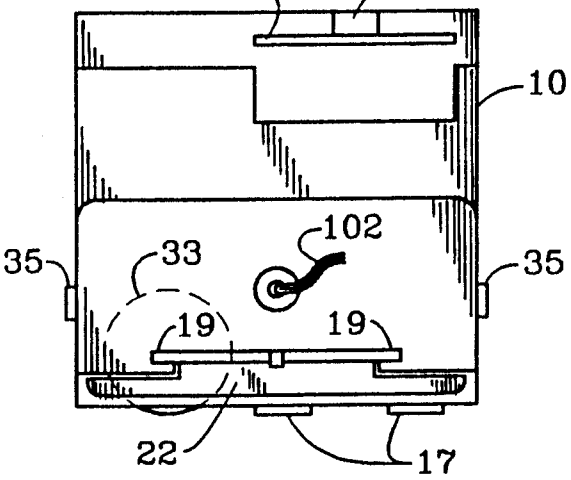
FIG. 2 is an end view of the printer of FIG. 1. It will be noted that, in this view, the printhead cartridge has been removed.
Figure 3:
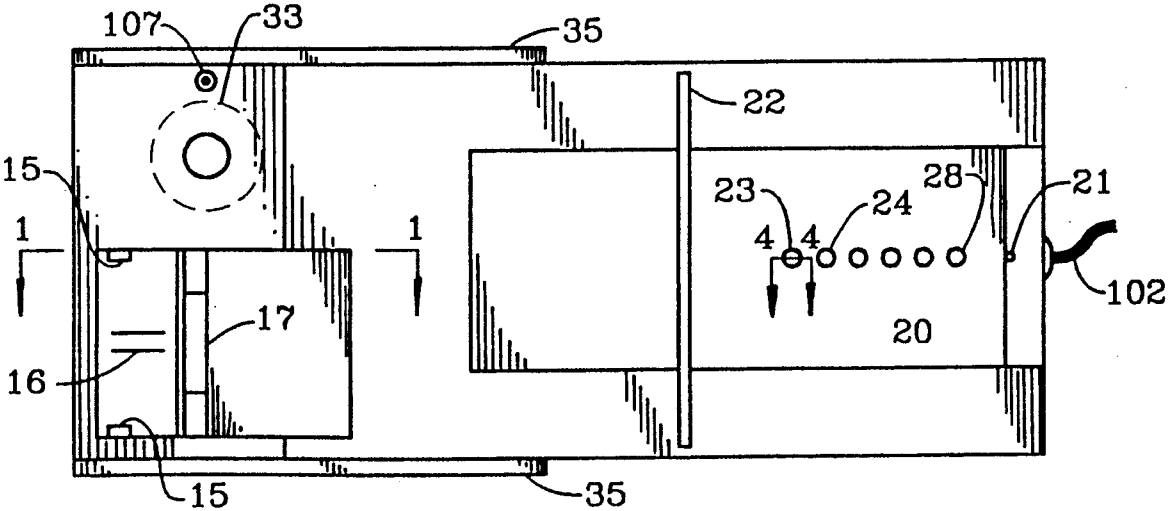
FIG. 3 is a bottom view of the printer of FIG. 1.
Figure 4:
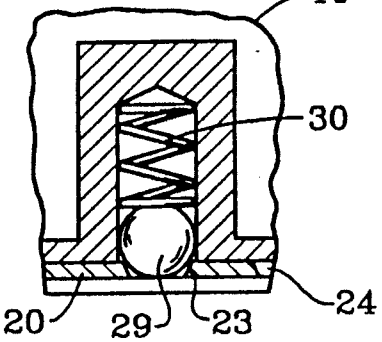
FIG. 4 is a fragmentary section of FIG. 3 taken at section 4—4 of FIG. 3.

FIGS. 1 through 3 show three views of the printer portion of a first embodiment of the invention. The printer portion is contained in a housing 10, which is of such size and shape as can be handled comfortably and conveniently in a person's hand. An internal cavity 11 houses the electronic circuitry needed to perform the required functions, as will be explained below. A replaceable "drop on demand" ink jet printhead cartridge 31 is removably mounted in an opening 12 which extends through the housing from top to bottom. The cartridge is held in place by a lip 13 on the housing, and by two projections 15 which extend from the inner surface of the opening 12, at the bottom. The projections engage recess 32 in the printhead cartridge, and a similar recess on the opposite side of the cartridge. A slot 14 provides some spring between the lip 13 and the housing proper so that the printhead cartridge can be snapped into place. The bottom of the printhead opening is open so that the ink jet orifices 16 are exposed. The cartridge illustrated is a Hewlett-Packard DeskJet cartridge, which has two columns of orifices 16 (represented in FIG. 3 by two short lines). Spacer 17 is attached to the housing 10 and, in use, rides on the top surface of the envelope to be addressed. The spacer 17 serves to assure the proper spacing between the envelope and the ink jet orifices, irrespective of the thickness of the envelope paper, and/or dimensional tolerances of the various other parts of the system.

A guide plate 20 is retained by grooves 19 in the housing 10. The guide plate is a close but not binding fit in these grooves. It should have little free motion in the lateral direction but should be easily movable front to back. Pin 21 retains the guide plate 20, preventing it from being inadvertently removed. A tongue 22 on the guide plate 20 is bent down at right angles to the rest of the guide plate, and extends beyond the bottom of housing 10, as can be seen in FIGS. 1 and 2. As will be discussed below, tongue 22 mates with a groove in the base member with which the printer is used. This combination is used to guide the printer in a linear motion, and also to maintain a constant angular orientation between the printer and the envelope.

A series of six holes 23 through 28 are pierced or drilled through guide plate 20. Ball 29 and spring 30 cooperate with the holes 23–28 to form a six position detent mechanism. The number of holes used will depend on the number of lines of text to be printed. Six holes will allow six lines of text to be printed; if more lines are desired, more holes should be provided. The spacing of the holes for text printing should be equal to the desired line spacing (usually 1/6 inch). If graphic printing is to be done using the embodiment of the invention as so far described, however, the holes should be spaced an amount equal to or less than the height of the swath made by the printhead. The reason for this will be discussed below.

Encoder ball 33 (located within the housing adjacent to ink jet cartridge 31) protrudes from the bottom of the housing and contacts the envelope to be printed. Inside the housing, the ball is coupled to a two axis encoder (horizontal position encoder 109 and vertical position encoder 110). While the ball 33 is free to rotate around any axis, it is constrained laterally to move with the housing 10. Hence, as long as the housing's angular orientation does not change, any change in the position of the ball with respect to the article being printed is a measure of the change in position of the printhead orifices with respect to the article being printed. Methods for translating the rotation of encoder ball 33 into two signals representative of its rotation around two orthogonal axes are well known in the art, and need not be described in detail.

As will be discussed later, encoders 109 and 110 (together with the associated hardware and software) enable the keeping track of printhead position within the print area in both the horizontal and vertical directions (i.e., the direction of the text on the envelope, and the direction perpendicular thereto).

Figure 5:
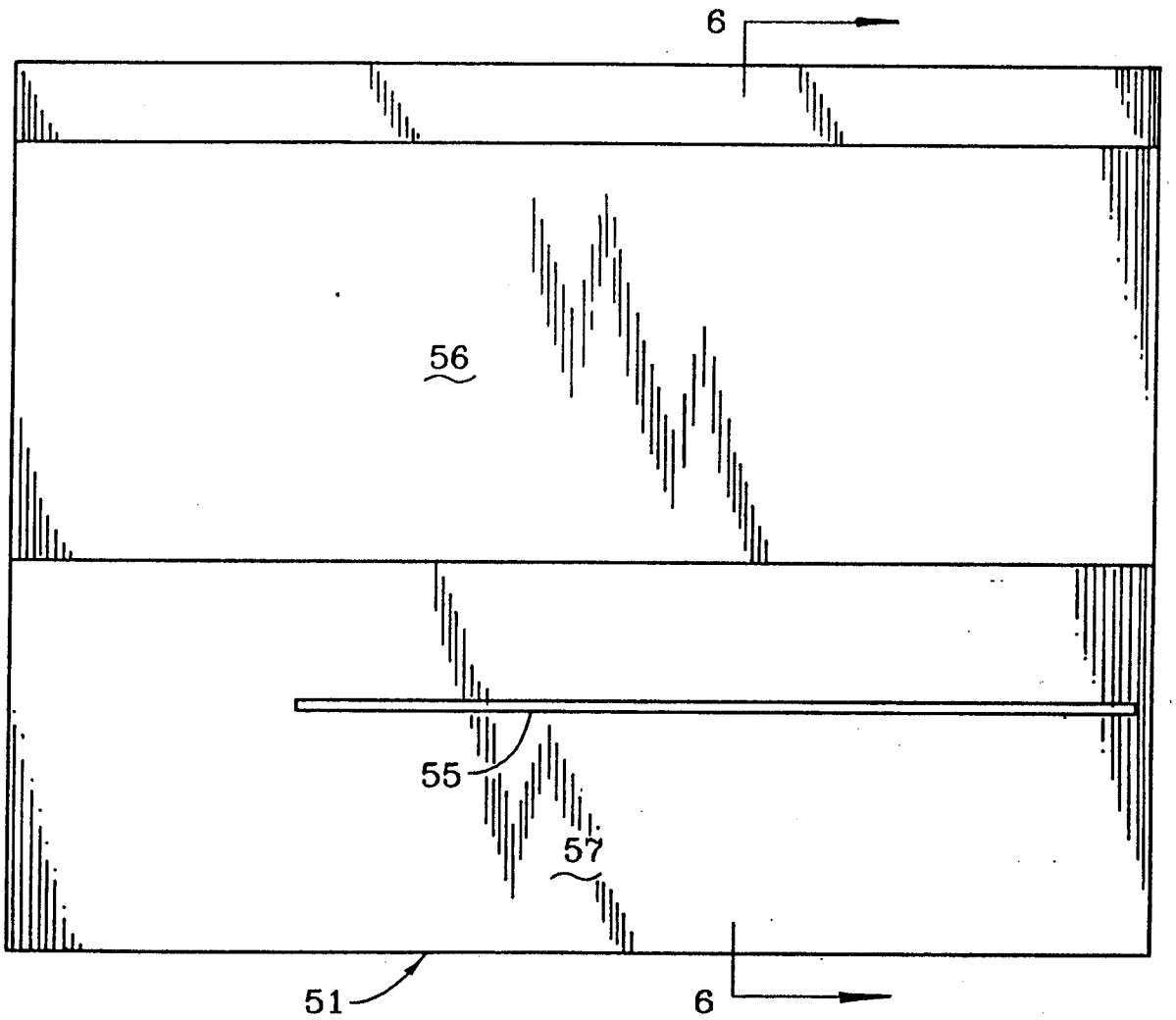
FIG. 5 is a top plan view of a base member for use with the printer of FIG. 1.
Figure 6:
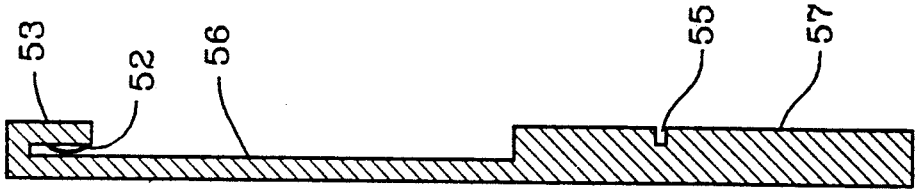
FIG. 6 is a cross sectional view of the base member of FIG. 5 taken at 6—6 of FIG. 5.

FIGS. 5 and 6 show a base member 51 on which the printer of FIGS. 1–4 rides when in use. The base member 51 includes a surface 56 on which the envelope to be addressed rests, and a surface 57 on which the bottom surface of printer housing 10 rides. The envelope is retained in place by spring 52 which is located under ledge 53. Tongue 22 of the printer rides in groove 55. It is preferred that spacer 17 just touch surface 56 when the printer is in place on surface 57. The thickness of an envelope under spacer 17 will then raise the printer slightly off the surface 57. Spacer 17 in contact with the envelope assures that the ink jet orifices are spaced the proper distance from the envelope surface irrespective of other tolerances. Spacer 17 is a particularly significant part when the invention is used for envelope printing with the preferred ink jet type of printhead. The top surface of an envelope on a flat platen, as is preferred, will tend to "float" somewhat above the platen and not be properly spaced from the ink jet orifices. The use of a single element, such as spacer 17, which extends between the ink jet cartridge and the surface of the envelope adjacent to the ink jet orifices, and which presses the envelope against the platen, assures that the proper orifice/envelope surface spacing is maintained during the printing operation.

Groove 55 allows the printer to be swept back and forth across the portion of the face of the envelope which is to contain the address, but the printer will always have a constant angular orientation with respect to the envelope, i.e., the columns of ink jet orifices 16 will always be perpendicular to the motion of the printer. It is preferred that the printer and the base member be linked, i.e., that a true constraint be accomplished, rather than that an arrangement be used, such as holding the printer against a straightedge, where the angular orientation of the printer depends on the care exercised by the user. This feature has significance because, as a practical matter, the position encoders must be placed some distance from the printhead orifices, and hence relatively small angular changes while the printer is being swept across the surface of the article being printed can result in ragged printing.

By moving the printer down one detent position after each scan of the printer across the envelope, a series of six lines of text can be printed on the envelope. As further discussed below, if the height of the swath printed by the ink jet orifices is equal to or greater than the distance between the detents, the printer will not be limited to printing lines of text, but it can also be used to print graphic images. When printing text, the detent holes 23–28 can be further apart than the height of the swath, if desired. Greater spacing between the holes results in the printed lines being further apart, but does not impact the printing quality.

Greater flexibility can be achieved while printing graphic images by dispensing with the detent mechanism, i.e., holes 23–28, ball 29, and spring 30. The hand held printer in this configuration can be moved over the area to be printed at will, the movement while printing not being limited to parallel spaced lines. Guideplate 20 running in grooves 19 and tongue 22 running in groove 55 maintain the angular orientation of the printer with respect to the article to be printed irrespective of how the printer is moved over the area to be printed. Control circuitry for controlling the printing function will be described below.

Figure 15:
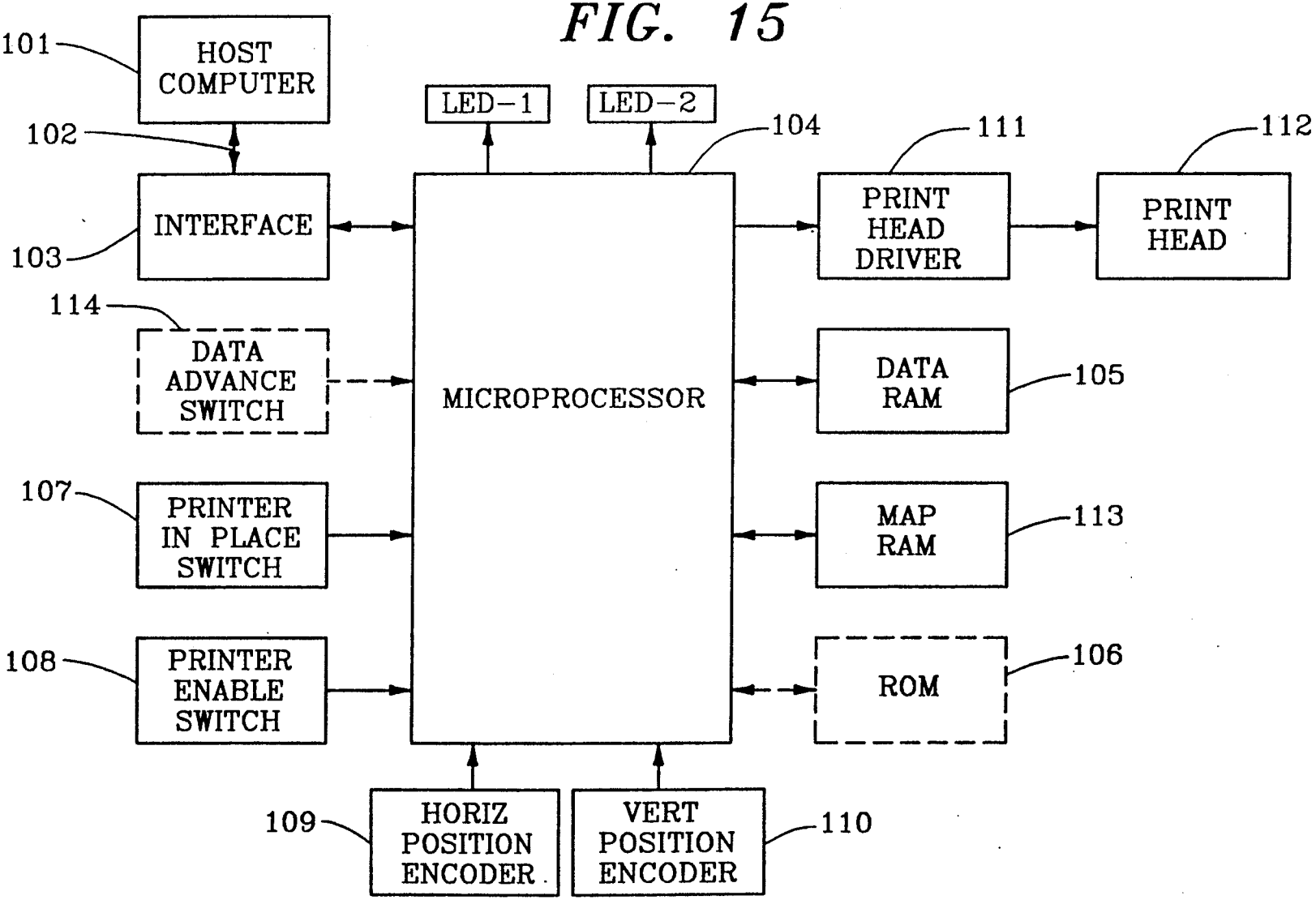
FIG. 15 is a simplified block diagram showing the major electronic blocks involved in the invention.

FIG. 15 is a simplified block diagram of the electronic aspects of the invention. The invented printer is intended to work in conjunction with a host computer 101 which is coupled to the printer via cable 102. Cable 102 couples both power and data to the printer, however, only the data path to interface 103 is shown in the diagram. It is preferred that a standard serial data transfer means, such as RS-232, be used, but non standard systems could be used if desired. Data representing the text or graphic to be printed can be selected and sent to the printer over cable 102 in accordance with any one of a number of well known prior art techniques, which need not be described here.

Interface 103 accepts data representing the text or other image to be printed from the host computer, and couples it, through microprocessor 104, to data RAM 105. It is preferred that the data be in the form of a bit map of the image to be printed, but the data could also be merely ASCII or other coded representations if textual characters are to be printed. In such case, an internal ROM containing bit map data for the font of characters to be printed would be provided within the printer. ROM 106 is shown dotted to represent this alternative. It is also possible to store mathematical character-generating equations in the ROM to generate the characters to be printed rather than bit maps.

The amount of data RAM required to store bit map data for the text to be printed will, of course, depend on the area to be covered. An area of about $3\times1.8$ inches should be adequate to provide for a reasonably large address, and also a postal bar code. Such an area can be bit mapped at 300 DPI with about 61 KB of memory, without using compression. It is believed that this amount of memory is so inexpensive that compression, though possible, will not likely be considered.

A pair of indicator lights LED-1 and LED-2 are preferably provided to indicate the status of the printer to the user. Neither LED-1 nor LED-2 are shown in FIGS. 1–3, but it will be understood that they may be mounted at any convenient location.

LED-1 is illuminated when the printer is ready to receive data from the host computer 101. When data is actually being transferred, it is preferred that LED-1 be placed in a blinking state to signal the user that data is being transferred. When the data transfer is complete, LED-1 reverts to a continuously on state. LED-2 is illuminated when the printer is in contact with the article to be printed and print enable switch 108 has been momentarily depressed, indicating that printing may commence. At the conclusion of printing, after all of the data in data RAM 105 has been printed, LED-2 is extinguished. This latter indication is convenient if the embodiment of the invention is used wherein the movement of the printer within the area to be printed is not constrained. Using this embodiment, it is possible for the user to miss areas of the image to be printed. If LED-2 is not extinguished, the user will know that some area has been skipped, and can take remedial action.

After a momentary power failure or other anomalous event, both LED's are set to a blinking mode.

Before beginning to print an address, the printer is placed on base member 51 with tongue 22 inserted in groove 55. The printer is then moved upward until ball 29 is mated with hole 23, and also to the left until the tongue 22 is touching the left end of groove 35.

The print enable switch 108 is effective, if, and only if, the printer-in-place switch 107 is on. When the printer is placed on the base member, the actuator of the printer-in-place switch 107 will contact the surface of the envelope to be printed, and turn it on. After the printer is in position, momentarily pressing the print enable switch 108 signals microprocessor 104 to reset two up/down counters located therein. One of the counters is associated with the horizontal position encoder 109, and the other counter is associated with the vertical position encoder 110, both encoders being driven from encoder ball 33. These counters keep track of the position of the printer in the horizontal and vertical directions relative to the starting point (i.e., the location of the printhead ink orifices when the print enable switch 108 was pressed).

After the up/down counters have been reset, the printer is in condition to print. In order to start printing the image corresponding to the data stored in data RAM 105, the printer is moved to the right. It is preferred to leave a small dead space of perhaps 60 counts of the horizontal position encoder before the printing begins. At 1/300 inch per count, 60 counts equals about 0.2 inches. After the dead space has been traversed, each positive count of the horizontal position encoder will cause the next column of dot data in the data RAM to be outputted to the printhead drivers, (i.e., columns A, B, C, etc.) which in turn will cause the appropriate ink jet orifices of the printhead 112 to emit ink drops. Note: For purposes of conceptualization, the data in data RAM 105 can be thought of as being arranged in rows and columns corresponding to the possible dot positions on the surface of the envelope in the area to be printed. Columns of dot positions proceeding to the right from the starting point of text printing are referred to (for convenience) as columns A, B, C, etc.

A negative count of the horizontal position encoder (corresponding to a printer move to the left) will cause the horizontal up/down counter to decrement, and therefore cause the data in the next lower lettered columns to be outputted (i.e., in sequence, columns Z, Y, X, etc.). Map RAM 113 keeps track of which data has been printed and prevents that data from being outputted more than once during the printing of an address. Note, in the preferred embodiment here being described, it is preferred that the data RAM not be emptied as the dots are printed, but rather that all data be retained in the data RAM until the data RAM is reset preparatory to receiving new text to be printed.

The vertical position encoder directs the data in the proper rows of the data RAM to the proper ink jet orifice actuator. This function is illustrated in the conceptual diagram of FIG. 16.

As noted above, for conceptual purposes, data RAM 105 can be thought of as comprised of columns of dot data, each column corresponding to all of the vertically aligned dots to be printed in the area covered. Hence, in a 300 DPI system with a print area of 3 inches wide by 1.8 inches high, the data RAM can be conceptualized as including 3×300 (or 900) columns of cells, and 1.8×300 (or 540) rows of cells. The total memory will thus contain 900 columns and 540 rows, or 486,000 cells. For explanatory purposes, the rods will be identified as 101, 102, 103, etc., and the columns as A, B, C, etc.

Figures 16A, 16B, 16C, 16D:
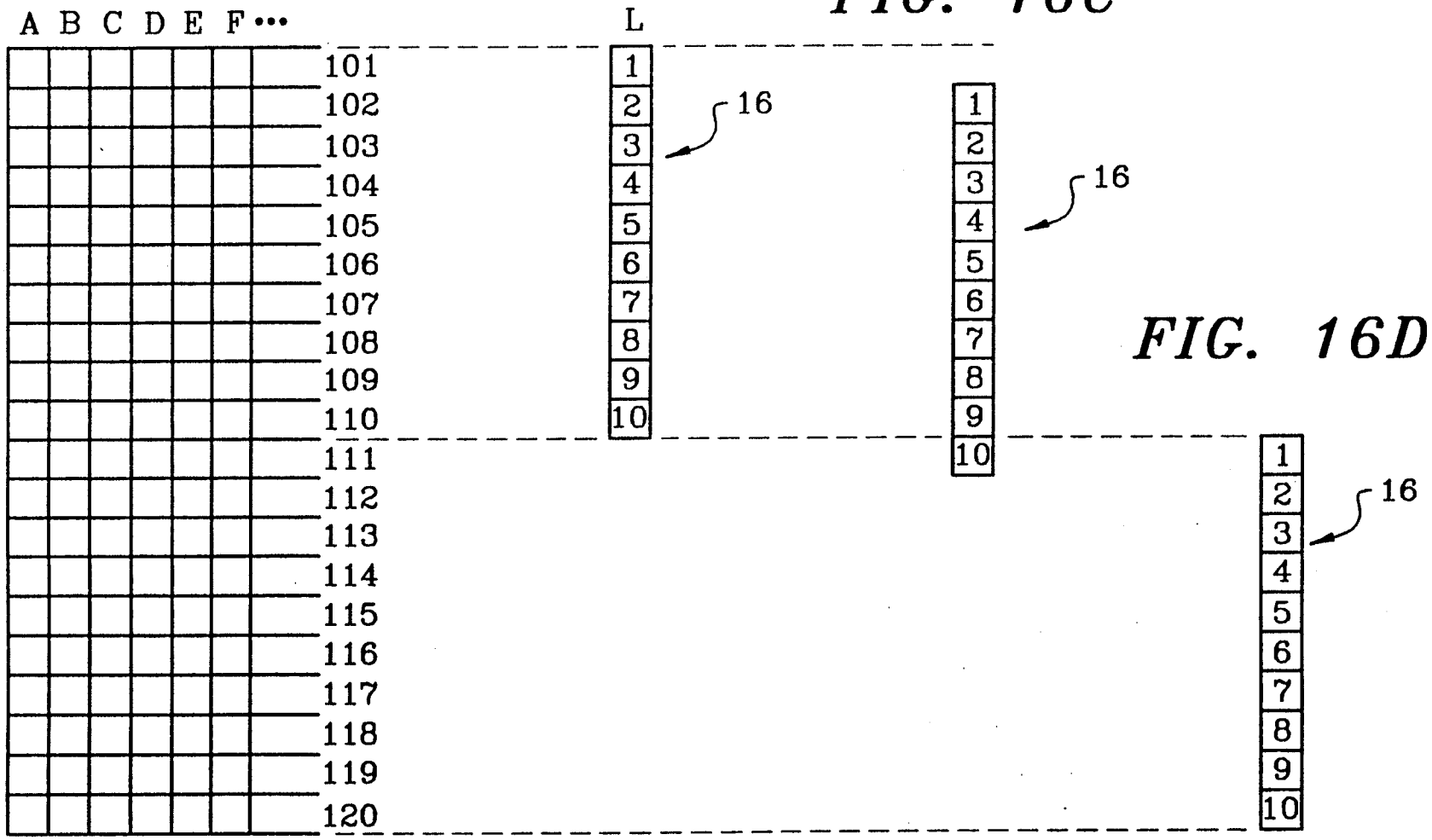
FIG. 16A, 16B, 16C, and 16D are conceptual diagrams to show how data is transferred to the printhead.

The cells of data RAM 105 can be further visualized as being placed on the area to be printed, so that each cell lies on the spot that a dot corresponding to the data in that cell can be printed. FIG. 16 is a diagram illustrating such a visualization, showing the relationship between the location of the printhead ink jet orifices when dots are formed, and the cells of data RAM 105 which contain the data representing the dots in the respective areas. In the simple example illustrated in FIG. 16, data RAM 105 is comprised of rows of cells 101, 102, 103, . . . 120, and columns A, B, C, etc. Printhead 112, for purposes of this simplified example, is shown as having ten ink jet orifices (numeral 16) arranged in a single column. As suggested above, one can think of the area to be printed as divided into small square areas, each one of which corresponds to a cell in the data RAM, and numbered similarly. Thus, the square in the upper left hand corner of the area to be printed would be numbered as in row 101, column A, the square to its right would be row 101, column B, etc. FIG. 16A shows this visualization for the area near the print starting point.

In FIG. 16B, the printhead orifices 16 (numbered 1-10) are shown in the horizontal position of column L, and in a vertical position aligned with rows 101-110 of the data RAM. This means that the printhead has been moved 12 counts of the horizontal position encoder to the right from the starting point (after the 60 count dead space), and ball 29 is precisely engaged with hole 23 (the top detent position). If the printer were moved such that ball 29 was precisely engaged with hole 24, the printhead would be aligned with cells 111-120. This situation is illustrated in FIG. 16D. For purposes of this illustration, assume that the data corresponding to the text to be printed (two rows of text) occupies rows 103-108 and rows 113-118 in columns A, B, C, etc. Dots corresponding to the data in rows 103-108 will be printed by ink jet orifices 3-8 when the printhead is in the position illustrated in FIG. 16B. As the printhead proceeds to the right through columns M, N, etc. the data in cell rows 103-108, columns M, N, etc. will be outputted to the printhead and be printed by ink jet orifices 3-8. The reason for and the significance of no data appearing in the two rows above and below the actual text height will be discussed below.

If, however, the user exerts a downward pressure on the printer while moving it to the right such that ball 29 comes out of hole 23 slightly, and the printhead becomes misaligned with the pattern of rows, as illustrated in FIG. 16C (printhead ink jet orifice 1 aligned with row 102 instead of row 101), it would be expected that the line of printing would drop correspondingly. This effect is avoided, however, by the action of vertical position encoder 110. As the printhead moves downward by one row, the vertical position encoder causes the vertical up/down counter in microprocessor 104 to increment by one. This causes the microprocessor to address rows one digit higher than previously for transmittal to the printhead. That is, whereas in the situation of FIG. 16B, the data from row 103 in the data RAM is transmitted to the actuator for ink jet orifice 3, in the situation of FIG. 16C, the data from data RAM row 103 will be transmitted to the actuator for ink jet orifice 2. Hence, the printing remains aligned.

FIG. 16D shows the situation wherein the printer has been indexed down exactly one detent position so that ball 29 now is in engagement with hole 24. The printhead is seen to be aligned with cells 111-120. Since the vertical position encoder has caused the vertical up/down counter to increment by ten counts, microprocessor 104 addresses cells 111-120 in data RAM 105 for transmittal to the printhead. The second row of text is therefore printed in proper vertical position.

It follows from the above discussion that it is desirable that if lines of text are to be printed, each line not occupy the full height of the swath of the printhead. The existence of printhead orifices both above and below the characters to be printed allows for the printing of full characters even if the printhead is slightly vertically misaligned, as described in connection with FIG. 16C. Similarly, if a graphic image is to be printed, some overlap should be provided in the printhead swaths. That is, the detent spacing is preferably slightly less than the height of the swath printed by the printhead. This will result in the full image being properly printed, even if the printhead becomes somewhat vertically misaligned. The comments of this paragraph relate to embodiments of the invention wherein the printer is scanned across the article to be printed in spaced straight lines and are not applicable to embodiments where the motion of the printer is unconstrained.

In the case of the example given above, it might be noted that rows 101, 102, 109, 110, 111, 112, 119, and 120 contain no data. In such a case, it is not necessary to actually provide memory space for the "phantom cells" above and below the actual text, so long as their absence is considered in the memory addressing scheme used. The number of "phantom cells" existing between lines of text (whether or not provided actual memory space) is determined by the physical space desired between lines of text and/or the amount of vertical misalignment tolerance desired. If it is intended to print taller text, or graphics, however, no phantom cells exist and all dot locations on the surface to be printed must provided with memory locations.

It will be realized from the above discussion, that, while generally convenient, there is no requirement that the movement of the printer be in straight lines across the area to be printed. So long as the angular orientation of the printer is maintained, and the area to be printed is eventually covered, the image will be printed. In certain instances it will be found to be convenient to not be constrained to printing in straight lines.

As previously described, the horizontal position encoder controls the column of the data RAM from which data is derived for transmittal to the printhead. Since the counters in the microprocessor are up/down counters, it is immaterial from which direction the printer approaches a given point on the area to be printed. Hence, lines can be printed while moving the printer from right to left or left to right, whichever is convenient for the user. Map RAM 113 keeps track of which dots have been printed, and prevents reprinting in the event that the same area is retraced.

If, for some reason, an envelope being printed is ruined, or a second envelope with the same address is desired to be printed, the user need only lift the printer from the base member, insert a new envelope, replace the printer on the base member and proceed to print a new envelope. Lifting the printer turns the printer-in-place switch 107 off, which resets the encoder counters and erases the map RAM 113. This permits the printing process to be started anew. As previously mentioned, it is preferred that data in data RAM 105 not be deleted as the printing progresses, but rather that the data RAM be reset only by action of the microprocessor in preparation for receiving a new data from the host computer 101.

Figure 7:
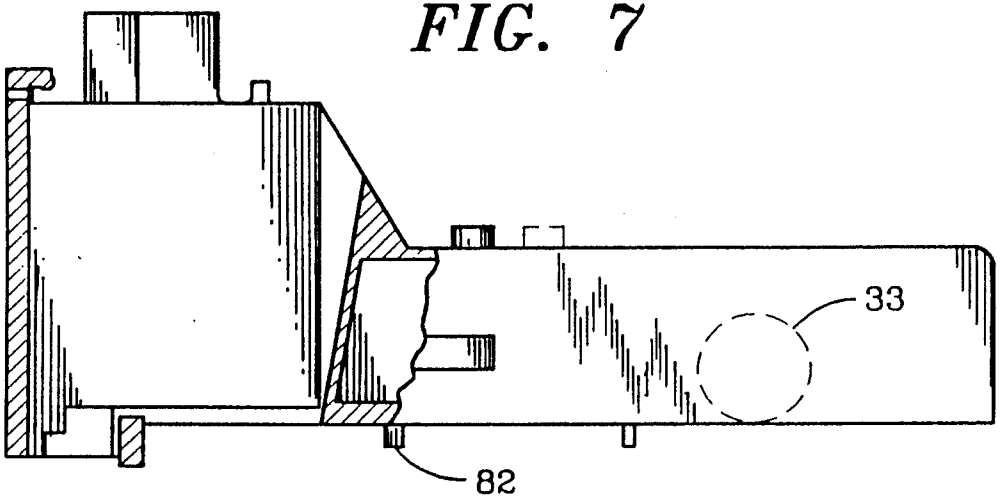
FIG. 7 is a partially sectioned side view of a printer for use in connection with a second embodiment of the present invention.

As described above, as the printer is moved into position to print a new line of text, vertical position encoder 110 is used to automatically select data from data RAM 105 corresponding to the line to be printed. An alternative means for selecting data corresponding to successive lines to be printed utilizes data advance switch 114, which is shown dotted on FIG. 15 to indicate that it is an optional component. Data advance switch 114 is a manually operable switch which selects the next line of text each time it is actuated. As shown in FIGS. 1 and 7, the switch is located on the housing 10 and is actuated by a finger motion of the user. The switch could also be coupled to the guide plate 20 of the embodiment of FIGS. 1–4, and actuated each time the guide plate is moved to a new detent location. Or, alternatively, the switch could be mounted on the housing 10 in such a manner that it is actuated each time the printer reaches the end of its travel. The switch 114 could also be an electronic switch instead of a mechanical one and automatically actuated, responsive to the movement of the printer, each time the printing of a line is completed. In the context of the example given above, data advance switch 114 would be used to increment the vertical up/down counter by ten counts each time it is actuated. If data advance switch 114 is used, the vertical position encoding means need not be provided, although such means (disabled during the inter-line motion of the printer) could still be useful to achieve straight line printing, if desired.

If, as described in connection with the embodiment described in the preceding paragraph, only a single axis position encoder is required, an encoder using a wheel turning on an axle, as described in the previously cited patent to Rowe, could possibly be used. It is, however, still preferred to use a free rolling encoder ball as described herein, but with only one pickoff, which is sensitive to the rotation of the ball around the axis parallel to the printed columns. The reason that this type of encoder is preferred is that in the present invention (as contrasted to the prior art types of hand held line printers) the printer is intended to be in contact with the surface to be printed as the printer is moved both along the line of printing, and while the printer is moved to a new line position. Moving the printer at right angles to the axis of a wheel type of encoder creates an unstable condition which can easily result in misalignment of the lines of text or other image to be printed.

Figure 8:
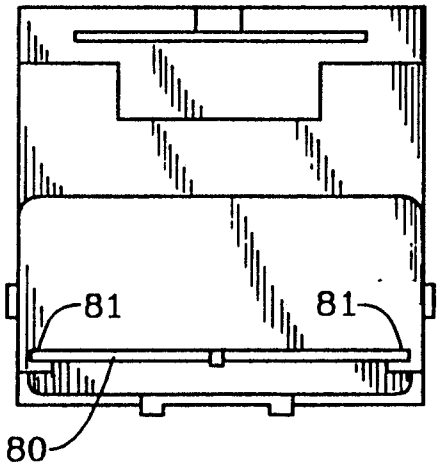
FIG. 8 is an end view of the printer of FIG. 7. It will be noted that, in this view, the printhead cartridge has been removed.
Figure 9:
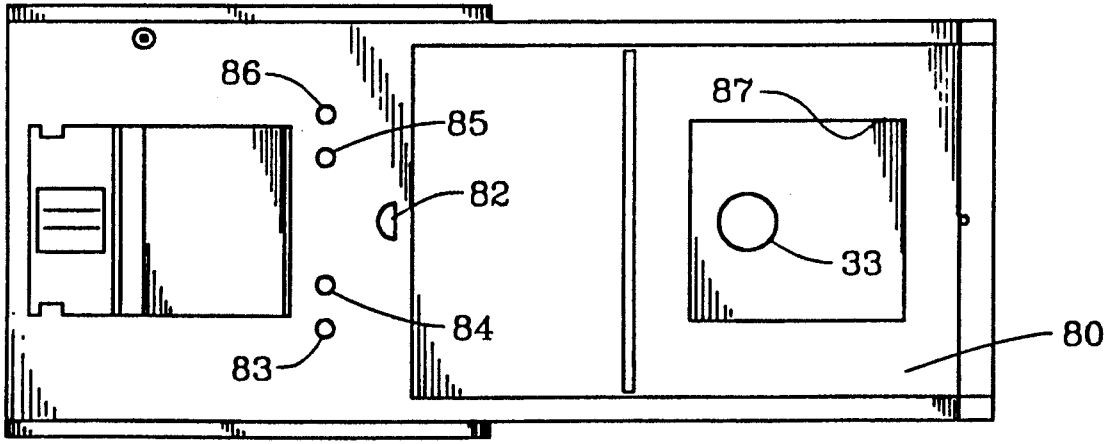
FIG. 9 is a bottom view of the printer of FIG. 7.

FIGS. 7–9 show a second embodiment of a printer according to the principles of this invention. In most respects this second embodiment is identical to the embodiment of FIGS. 1–4, but the means for guiding the printer in straight line segments is different. Also, the embodiment shown in FIGS. 7–9 depicts a few alternate construction details which may be used in connection with other embodiments of the invention, as appropriate. For example, the embodiment of FIGS. 7–9 is a "cordless" version of the printer; also encoder ball 33 is located in the handle portion of housing 10 and rides on the base member instead of the envelope to be printed.

Instead of a ball type of position encoder as shown in the mechanical figures, position encoders 109 and 110 may be of an optical type, i.e., encoders in which an optical grid is placed on the base member, and the horizontal and vertical crossings of the lines of the grid are detected by photocells within the housing 10.

As seen in FIG. 9, guide plate 80 is similar in most respects to guide plate 20 of the first embodiment, but holes 23–29 have no counterpart in guide plate 80. Also absent in this second embodiment is the remainder of the detent mechanism shown in FIG. 4. Guide plate 80 is free to move back and forth in grooves 81 without restraint. An opening 87 in the guide plate 80 permits encoder ball 33 to protrude and contact the base member. A guide pin 82, which performs a function roughly similar to that performed by the detent mechanism of the first embodiment, protrudes from the bottom of the housing of the printer.

Figure 10:
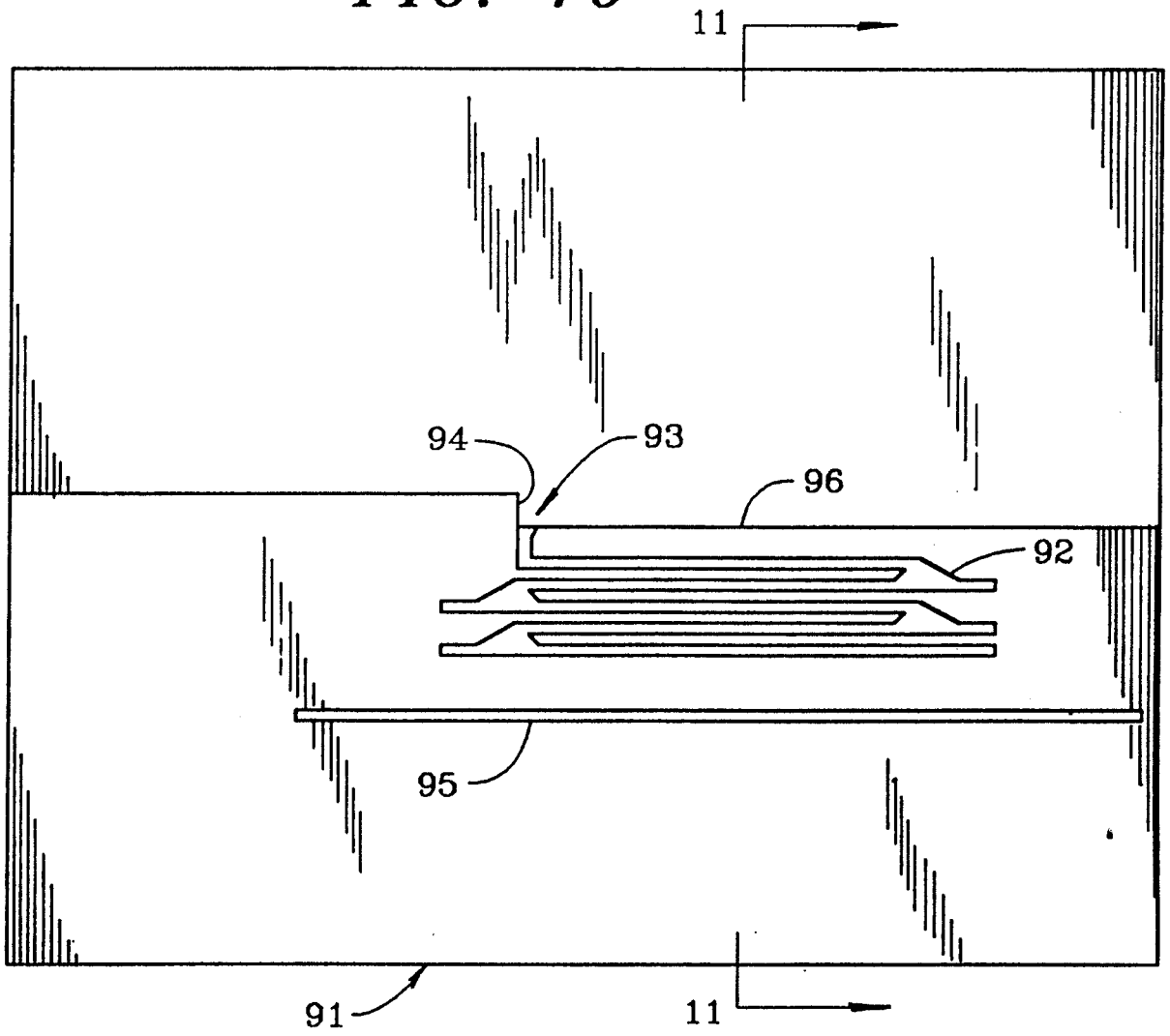
FIG. 10 is a top plan view of a base member for use with the printer of FIGS. 7-9.
Figure 11:
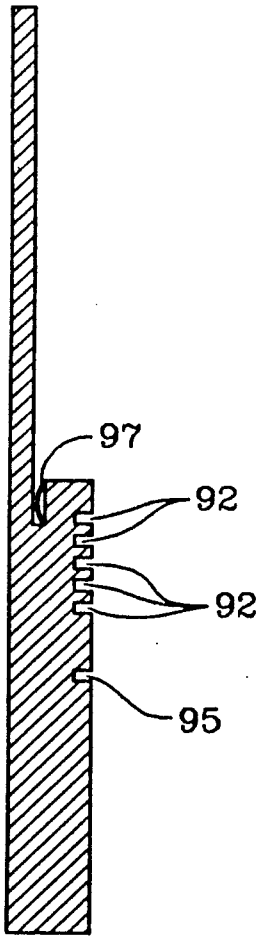
FIG. 11 is a cross sectional view of the base member shown in FIG. 10, taken at 11—11 of FIG. 10.

FIGS. 10 and 11 show a base member which can be used in connection with the printer of FIGS. 7–9. The base member 91 is similar to base member 51 used in connection with the first embodiment, but there are some differences. As an alternative to being held by a spring at the top of the envelope, the envelope in this embodiment is shown as being retained by a spring 97 in a recess at the bottom of the envelope. More significantly, the base member 91 includes a zig-zag groove 92 in which guide pin 82 rides. Guide pin 82 is brought to the print starting position at the left end of the top straight line segment by placing the printer on the base member with the tongue of guide plate 80 in groove 95 and guide pin 82 above edge 96 of the base member top surface. Moving the printer down and to the left until guide pin 82 contacts edge 96 and then edge 94 brings the guide pin to the open end of entry groove 93. Moving the printer down then brings the printer to the starting position at the left end of the top segment of groove 92. An address can then be printed by momentarily depressing the print enable switch 108 and moving the printer in zig-zag fashion following groove 92 to its end.

There are many possible configurations for the segment end transitions of groove 92. The one illustrated forces the printer to move downward at the end of each segment to be in position to enter the next segment when the user moves the printer in the opposite direction. Other segment end transitions may be used if desired.

In the cordless version of the printer, rechargeable batteries within the printer housing power the printer electronics and printhead. Battery charging power and data are received from a "cradle" (not shown) in which the printer rests when not in use. Four electrical contacts 83–86 on the bottom of the printer housing are shown in FIG. 9. These contacts, through which the recharging power and data are coupled, mate with contacts in the cradle. The cradle, in turn, is connected by cable to the host computer. The disclosure of four contacts to provide the electrical coupling between the cradle and the printer is intended to be illustrative of the manner of coupling, and not definitive as to the actual number of contacts needed with any particular data transfer protocol.

Figure 12:
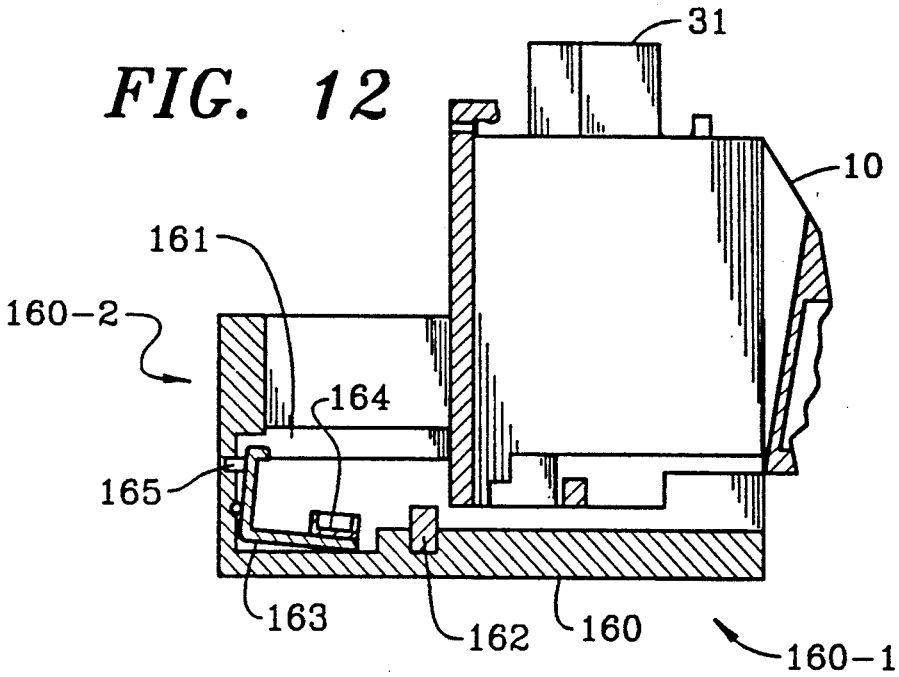
FIG. 12 is a sectioned side view of a storage unit for the invented printer. The section is taken at 12—12 of FIG. 14. The storage unit is shown with a printer partially inserted. Only a part of the printer is shown, for clarity. The printer section is taken at 1—1 of FIG. 3.
Figure 13:
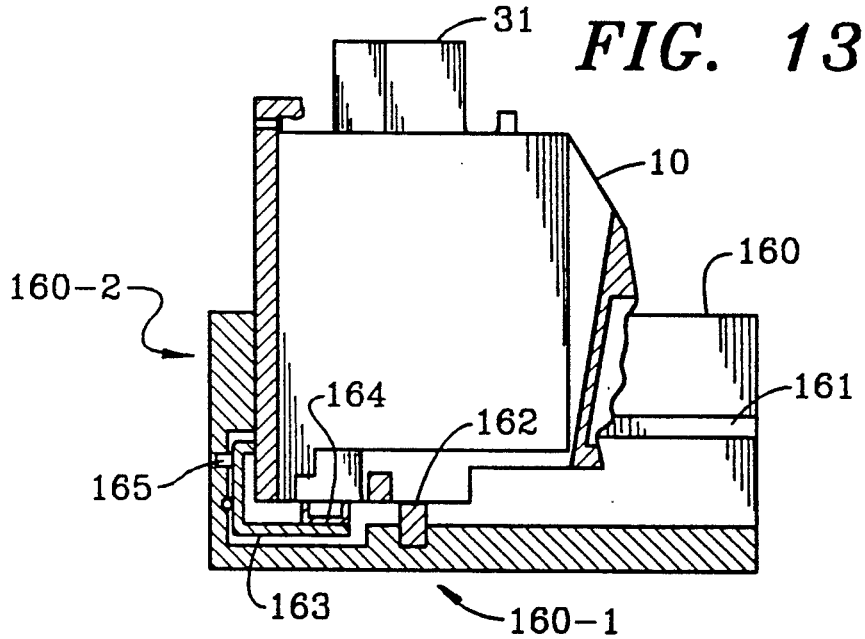
FIG. 13 is a sectioned side view of the storage unit, as is shown in FIG. 12 with, the printer completely inserted and in its stored position.
Figure 14:
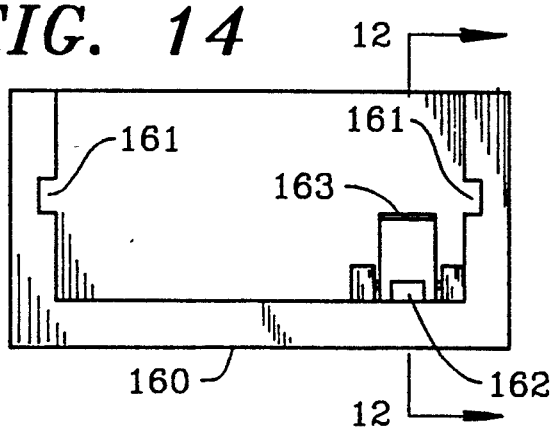
FIG. 14 is an end view of the storage unit. A printer is not included in this view.

FIGS. 12, 13, and 14 depict a storage unit for the invented hand held printer. As noted in the Summary section, the preferred type of printhead for use in the invented printer is a "drop on demand" type of ink jet printhead. Also noted was the fact that such printheads tend to pick up debris from the surface of the paper on which they print, and that in addition, there was a tendency for ink to dry and to clog the printhead orifices. The storage unit includes both a wiping means for cleaning debris from the printhead orifice area and a cap for the orifice area which retards drying of the ink.

The cross sectional views of the storage unit seen in FIG. 12 and 13 include a small sectioned fragment of a printer housing 10 along with a printhead cartridge 31, included for the purpose of illustrating how the parts of the storage unit function. In FIG. 12, the printer is shown partly inserted, while in FIG. 13, the printer is shown completely inserted, in its storage position. The sectioning of the printer is taken at the same place as the section in FIG. 1, i.e., at 1—1 of FIG. 3.

A base unit 160 is provided to receive the printer unit as shown, with runners 35 on the printer housing sliding in grooves 161. The base unit 160 can be positioned with its base surface 160-1 down, or with the end surface 160-2 down, as convenient. Surface 160-1 can also be attached to a vertical surface, such as the side of a computer monitor (with surface 160-2 down) if desired.

FIG. 12 shows a printer part way inserted. As the printer is pushed farther into the storage unit, the orifice area of the print cartridge 31 brushes over cleaning pad 162 which brushes paper fiber and other debris off the printhead orifice area. When the printer reaches the end of the opening in the base unit, as shown in FIG. 13, the front of housing 10 engages lever 162, which pivots the cap 164 up to cover the orifices of the printhead cartridge 31. Cap 164 is preferably made of a soft rubber or other elastomer.

When the printer is removed from the storage unit, cap 164 falls away from the cartridge as soon as the movement starts, being biased to the down position by a piece of soft sponge 165. Cleaning pad 162 again wipes the orifice area as the printer is removed. As can be seen in FIG. 2, spacer 17 is relieved in the center so that it does not touch cleaning pad 162.

While the present invention has been described in the context of printing addresses on business envelopes, it should be understood that the invention will also be useful for printing address labels for large envelopes and packages, as a page printer for printing a few pages of text, and, as well, for printing graphic images of relatively small size on any surface. Other applications will no doubt occur to those skilled in the art, as will various modifications and other embodiments of the invention, all of which are intended to be covered by the following claims.

We claim:

1. A hand held multiline printing system which comprises:

a base member;

means associated with said base member for holding an article to be printed;

a hand held printer, including a printhead having one or more printing elements, said printer being adapted to be manually moved across said article to be printed along more than one axis;

means for maintaining said printing elements at substantially a constant distance from said article to be printed while said printer is moved across said article to be printed along said more than one axis; and linking means for linking said hand held printer to said base member whereby said hand held printer is held in a fixed angular orientation with respect to said article to be printed while said printer is moved across said article to be printed along said more than one axis, and while said printing elements are being maintained at said substantially a constant distance from said article to be printed.

2. A hand held multiline printing system as recited in claim 1 and further including printer positioning means having discrete manually selected positions whereby the motion of said hand held printer while printing is limited to motion along a plurality of parallel line segments spaced predetermined distances apart.

3. A hand held multiline printing system as recited in claim 2 where said printer positioning means includes a detent mechanism operating between said hand held printer and said base member.

4. A hand held multiline printing system as recited in claim 2 where said printer positioning means comprises:

a member constrained to move linearly with respect to said article to be printed; and means acting between said member and said hand held printer whereby said hand held printer can be positioned at any one of a plurality of predetermined positions with respect to said member.

5. A hand held multiline printing system as recited in claim 4 where said means acting between said member and said hand held printer are detent means.

6. A hand held multiline printing system as recited in claim 2 where said printer positioning means comprises:

a projection extending from said hand held printer; and a plurality of parallel grooves in said base member which mate with said projection extending from said printer.

7. A hand held multiline printing system as recited in claim 6 where said parallel grooves are connected in zig-zag fashion.

8. A hand held multiline printing system as recited in claim 1 where said means for maintaining said printing elements at substantially a constant distance from said article to be printed comprises a spacing member mounted on said hand held printer adjacent to said printing elements, and adapted to ride on the surface of said article to be printed whereby the area of said article to be printed under said printing elements will be positioned against said base member.

9. A hand held multiline printing system as recited in claim 8 and further including printer positioning means having discrete manually selected positions whereby the motion of said hand held printer while printing is limited to motion along a plurality of parallel line segments spaced predetermined distances apart.

10. A hand held multiline printing system as recited in claim 9 where said printer positioning means comprises:

a member constrained to move linearly with respect to said article to be printed; and means acting between said member and said hand held printer whereby said hand held printer can be positioned at any one of a plurality of predetermined positions with respect to said member.

11. A hand held multiline printing system as recited in claim 10 where said means acting between said member and said hand held printer are detent means.

12. A hand held multiline printing system as recited in claim 9 where said printer positioning means comprises:

a projection extending from said hand held printer; and a plurality of parallel grooves in said base member which mate with said projection extending from said printer.

13. A hand held multiline printing system as recited in claim 12 where said parallel grooves are connected in zig-zag fashion.

14. A hand held printing system which comprises:

a housing adapted to be manually moved across an article to be printed;

a printhead carried by said housing;

position encoder means for generating position signals responsive to a change in position of said housing which comprises:

a ball carried within said housing, said ball protruding from said housing and rolling on said article to be printed, said ball being free to roll around any axis, but having a fixed position relative to said housing;

first means coupled to the surface of said ball for producing first change in position signals responsive to the rotation of said ball around a first axis;

a memory for storing data signals representative of an image to be printed; and means responsive to said position signals for selecting data signals to be coupled to said printhead.

15. A hand held printing system as recited in claim 14 where said position encoder means further includes second means coupled to the surface of said ball for producing second change in position signals responsive to the rotation of said ball around a second axis, said position signals including both said first and said second change in position signals.

16. A printing system which comprises:

a printer having a printhead which prints an image by printing a plurality of dots, said dots being arrayed in rows and columns;

a base member for holding an article to be printed;

linking means for linking said printer to said base member whereby said printer is held in a fixed angular orientation with respect to an article to be printed while said printer is being manually swept over a predetermined area of said article;

memory means for storing data signals, said data signals representing dots of an image to be printed;

manually actuated first means for selecting a class of data from said memory means, the class of data selected by said first means being the data corresponding to rows of dots to be printed;

position encoding means for producing a signals responsive to changes in the relative position between said printer and said article to be printed in the direction of said rows, said position encoding means comprising:

a ball riding on a surface having a fixed position relative to the surface to be printed, said ball being free to roll, but having a fixed position relative to said printhead, and means coupled to said ball for producing signals responsive to the rotation of the surface of said ball around an axis parallel to said columns as printed;

second means, responsive to said signals produced by said position encoding means, for selecting a class of data from said memory means, the class of data selected by said second means being the data corresponding to columns of dots to be printed; and third means for coupling the signals corresponding to the data selected by both of said first means and said second means to said printhead whereby dots corresponding thereto will be printed.

17. A printing system as recited in claim 16 wherein said position encoding means rolls on the surface of the article being printed.

18. A printing system which comprises:

a printer having a printhead which prints an image by printing a plurality of dots, said dots being arrayed in rows and columns;

means for maintaining said printer in a fixed angular orientation with respect to an article to be printed while said printer is being manually swept over a predetermined area of said article;

first position encoding means for producing signals responsive to a change in relative position between said printer and said article to be printed in the direction of said rows;

second position encoding means for producing signals responsive to a change in relative position between said printer and said article to be printed in the direction of said columns;

memory means for storing data signals, said data signals representing dots of an image to be printed;

means responsive to signals produced by both of said first and said second position encoding means to select data signals from said memory means for coupling to said printhead.

19. A printing system as recited in claim 18 and further including means for limiting the sweeping motion of said printer in the direction of said rows to a plurality of parallel line segments spaced a predetermined distance apart.

20. A printing system as recited in claim 19 and further including:

a member constrained to move linearly with respect to said article to be printed; and means acting between said member and said printer whereby said printer can be positioned at any one of a plurality of predetermined positions with respect to said member.

21. printing system as recited in claim 20 where said means acting between said member and said printer are detent means.

22. A printing system as recited in claim 19 and further including:

a projection extending from said printer; and a plurality of parallel grooves in said base member which mate with said projection extending from said printer.

23. A printing system as recited in claim 22 where said parallel grooves are connected in zig-zag fashion.

24. A printing system as recited in claim 18 wherein both of said position encoding means are mechanically driven from the surface of the article to be printed.

25. A printing system as recited in claim 18 wherein said first and second position encoding means are comprised of:

a ball riding on a surface having a fixed position relative to the surface to be printed, said ball being free to roll, but having a fixed position relative to said printhead;

first means coupled to said ball for producing signals responsive to the rotation of the surface of said ball around a first axis; and second means coupled to said ball for producing signals responsive to the rotation of the surface of said ball around a second axis.

26. A printing system as recited in claim 25 wherein said ball rides on the surface to be printed.

27. A printing system as recited in claim 18 wherein said first and second position encoding means are comprised of:

a pattern of two sets of orthogonally related lines on a surface having a fixed relationship with an article to be printed;

first optical means for producing signals responsive to the change in position of said printer in the direction of one of said sets of lines; and second optical means for producing signals responsive to the change in position of said printer in the direction of the other of said sets of lines.

* * * * *